US008526863B2

(12) United States Patent
Hayashi et al.

(10) Patent No.: US 8,526,863 B2
(45) Date of Patent: Sep. 3, 2013

(54) TONER DISCHARGE MECHANISM, TONER CARTRIDGE AND IMAGE FORMING APPARATUS USING THE TONER CARTRIDGE

(75) Inventors: Shigeki Hayashi, Osaka (JP); Takafumi Nagai, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 256 days.

(21) Appl. No.: 13/035,129

(22) Filed: Feb. 25, 2011

(65) Prior Publication Data

US 2011/0229212 A1 Sep. 22, 2011

(30) Foreign Application Priority Data

Mar. 16, 2010 (JP) ..... 2010-059731

(51) Int. Cl.
*G03G 15/08* (2006.01)

(52) U.S. Cl.
USPC ..... 399/263; 399/256

(58) Field of Classification Search
USPC ..... 399/256, 263; 198/657
See application file for complete search history.

(56) References Cited

U.S. PATENT DOCUMENTS 5,812,916 A 9/1998 Kishimoto et al.

FOREIGN PATENT DOCUMENTS

| | | | |
|---|---|---|---|
| JP | 2001-249543 | | 9/2001 |
| JP | 2004-029596 | | 1/2004 |
| JP | 2006-235255 | | 9/2006 |
| JP | 2008-032769 | | 2/2008 |
| JP | 2009-210721 | | 9/2009 |
| JP | 2009210721 A | * | 9/2009 |
| JP | 2009-276443 | | 11/2009 |

* cited by examiner

*Primary Examiner* — David Gray
*Assistant Examiner* — Michael Harrison
(74) *Attorney, Agent, or Firm* — Nixon & Vanderhye P.C.

(57) ABSTRACT

A toner discharge mechanism which is attached to a toner cartridge includes an auger screw for conveying and discharging a toner stored in the toner cartridge, the auger screw having an end portion downstream thereof, the end portion forming a taper portion having a predetermined length and an outer diameter diminishing toward a tip thereof; a cover member for covering the taper portion, the cover member having a conical inner wall configured to correspond to a taper shape of the taper portion; and a toner discharge outlet formed on the cover member.

7 Claims, 5 Drawing Sheets

200
201
202
202a
202b
202c
204
204a
204b
105
206
207
A
A'
B
B'
C
C'
D
D'
F

TONER DISCHARGE MECHANISM, TONER CARTRIDGE AND IMAGE FORMING APPARATUS USING THE TONER CARTRIDGE

CROSS-REFERENCE TO RELATED APPLICATION

This application is related to Japanese patent application No. 2010-059731 filed on Mar. 16, 2010 whose priority is claimed under 35 USC §119, the disclosure of which is incorporated by reference in its entirety.

BACKGROUND OF THE INVENTION

1. Field of the Invention

The present invention relates to a toner discharge mechanism, a toner cartridge, and an image forming apparatus using the toner cartridge.

2. Description of the Related Art

A developing device using a two-component developer is structured such that, when a toner in the developing device has been consumed and reduced by image forming, a toner cartridge supplies the toner to the developing device so as to prevent a concentration of the toner of the developer from being less than or equal to a predetermined value.

For example, a toner cartridge is known which includes: a toner storage section for storing a toner to be supplied; a toner discharge outlet through which the toner is discharged toward a developing device; and a toner conveying screw (auger screw) for conveying the toner from the toner storage section to the toner discharge outlet (see, for example, Japanese Unexamined Patent Application No. 2006-235255).

Further, another toner discharge device is also known which includes: a toner conveying path formed in a cylindrical shape; an auger screw which is rotatably mounted in the toner conveying path, and a toner discharge outlet on a lowermost stream side in a toner conveying direction, wherein the auger screw includes a reversed helical blade (reversed spiral) on the lowermost stream side (see, for example, Japanese Unexamined Patent Application No. 2008-32769).

However, in a toner cartridge which allows a toner to be discharged through the toner discharge outlet by using the auger screw, a fluidity of the toner may be reduced due to, for example, the toner cartridge having been transported over a long distance or the toner cartridge having being left unused for a long period of time. Therefore, when driving of the auger screw is recommenced, the toner stored in the vicinity of the toner discharge outlet is not smoothly discharged through the toner discharge outlet. The toner which is accumulated on an inner wall surface (a wall surface for bearing the auger screw) in the lowermost stream portion of the toner cartridge, and the toner pushed to the downstream side in the toner conveying direction by the rotation of the auger screw cannot move anywhere, and are tightly packed, so that the auger screw stops rotating (by locking phenomenon).

Further, the use of the auger screw including the reversed helical blade on the lowermost stream side can prevent the toner from being accumulated on a surface (a wall surface for bearing the auger screw) in the lowermost stream portion of the toner cartridge. However, once the toner stored in the vicinity of the toner discharge outlet cannot be smoothly discharged through the toner discharge outlet, the toner pushed in the toner conveying downstream direction by the rotation of the auger screw, and the toner pushed back due to the opposite spiral by the rotation of the auger screw, hit against each other at one point. Therefore, a pressure rapidly rises, and the toner is tightly packed, resulting in occurrence of the locking phenomenon. That is, the problem that the locking phenomenon of the auger screw occurs is not solved.

SUMMARY OF THE INVENTION

The present invention is made in order to solve the aforementioned problems, and an object of the present invention is to provide a toner discharge mechanism and a toner cartridge which can prevent the tightly packed toner from causing occurrence of the locking of the auger screw, and an image forming apparatus using the toner cartridge.

The present invention provides a toner discharge mechanism which is attached to a toner cartridge comprising:

an auger screw for conveying and discharging a toner stored in the toner cartridge, the auger screw having an end portion downstream thereof, the end portion forming a taper portion having a predetermined length and an outer diameter diminishing toward a tip thereof; a cover member for covering the taper portion, the cover member having a conical inner wall configured to correspond to a taper shape of the taper portion; and a toner discharge outlet formed on the cover member.

According to the present invention, the tapered portion having an outer diameter reduced toward a tip thereof is formed in an end portion on a downstream side of the auger screw, and the end portion has a predetermined length. Further, the tapered portion is covered with a cover member having a conical inner wall which corresponds to a tapered shape of the tapered portion, and a toner discharge outlet is formed on the cover member. Therefore, in the cover member, an internal space in the vicinity of the toner discharge outlet is gradually reduced in the toner conveying direction, so that the conveyed toner is gradually pushed toward the toner discharge outlet, and is smoothly discharged. As a result, the toner conveyed toward the toner discharge outlet is slowly pushed to the toner discharge outlet, so that a tightly packed state of the toner which is caused by a rapid pressure change can be avoided, and occurrence of the locking phenomenon of the auger screw can be prevented.

DESCRIPTION OF THE PREFERRED EMBODIMENTS

Figure 1:
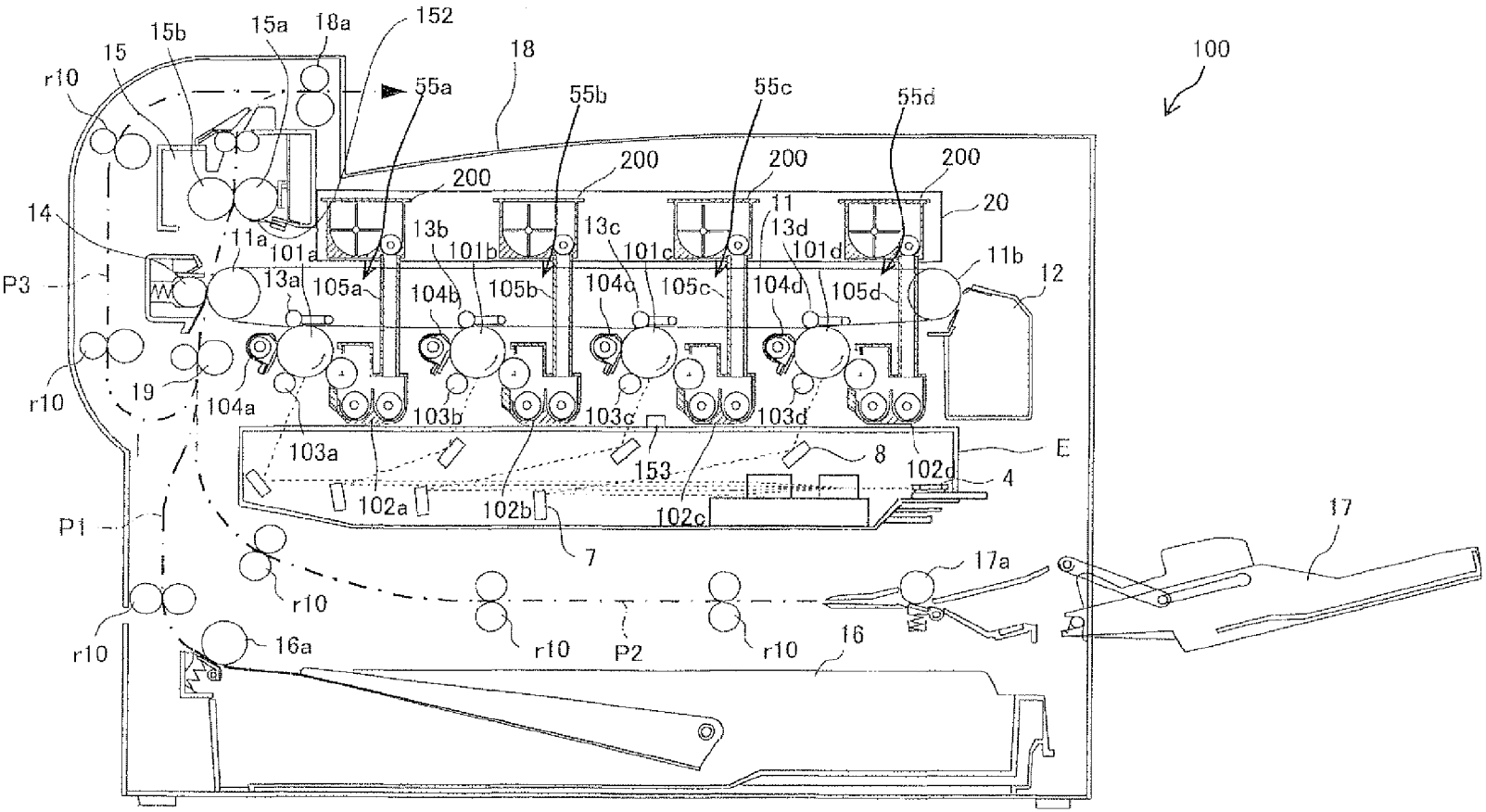
FIG. 1 is a diagram illustrating a structure of an image forming apparatus according to the present invention.

The toner discharge mechanism according to the present invention has the features described below.

Specifically, the present invention is directed to a toner discharge mechanism which is mounted in a toner cartridge having an auger screw operable to convey through and discharge from the toner cartridge a toner stored therein, and the toner discharge mechanism includes a tapered portion having an outer diameter reduced toward a tip thereof, in an end portion on a downstream side in a direction in which the toner is conveyed by the auger screw, the end portion having a predetermined length. Further, in the toner discharge mechanism, the tapered portion is covered with a cover member having a conical inner wall which corresponds to a tapered shape of the tapered portion, and a toner discharge outlet is formed on the cover member.

Further, the toner cartridge according to the present invention has the features described below.

Specifically, the present invention is directed to a toner cartridge which has an auger screw operable to convey through and discharge from the toner cartridge a toner stored therein, and the toner cartridge includes a tapered portion having an outer diameter reduced toward a tip thereof, in an end portion on a downstream side in a direction in which the toner is conveyed by the auger screw, the end portion having a predetermined length. Further, in the toner cartridge, the tapered portion is covered with a cover member having a conical inner wall which corresponds to a tapered shape of the tapered portion, and a toner discharge outlet is formed on the cover member.

The auger screw has an elongated shaft (axis) around which a helical blade is wound, and rotates the shaft to convey the toner by using a contact pressure of the helical blade against the toner. The auger screw may be also referred to as a toner conveying screw.

In the toner discharge mechanism and the toner cartridge according to the present invention, a minimal value of an inner diameter of the conical inner wall portion is preferably greater than or equal to 1.1 times a diameter of a rotating shaft, and is not greater than 1.5 times the diameter of the rotating shaft.

When the minimal value of the inner diameter of the conical inner wall portion is excessively great, an effect of pushing out the toner through the toner discharge outlet is insufficient, whereas when the minimal value is excessively small, a friction and a shear force generated in the toner between the rotating shaft and the inner wall is increased, so that the toner having its temperature increased is likely to become agglomerated, resulting in the locking phenomenon of the auger screw being likely to occur. However, according to the present invention, the toner is smoothly discharged through the toner discharge outlet, and the temperature increase and agglomeration of the toner are prevented, thereby enhancing an effect of preventing occurrence of the locking of the auger screw.

Further, the minimal value of the inner diameter of the conical inner wall portion is preferably greater than or equal to 0.2 times a maximal value of the inner diameter of the conical inner wall portion, and is not greater than 0.5 times the maximal value of the inner diameter of the conical inner wall portion.

When the minimal value of the inner diameter of the conical inner wall portion is excessively small, the diameter of the rotating shaft needs to be reduced, so that the rigidity of the rotating shaft is reduced, and a friction heat is likely to be generated due to contact between the conical inner wall and the helical blade. On the other hand, when the minimal value is excessively great, an effect of pushing out the toner through the toner discharge outlet is insufficient. According to the present invention, the toner is smoothly discharged through the toner discharge outlet, and the temperature increase and agglomeration of the toner are prevented, thereby enhancing an effect of preventing occurrence of the locking of the auger screw.

Further, another aspect of the present invention is directed to an image forming apparatus which includes: a photoconductor drum; a charging device for charging a surface of the photoconductor drum; an exposure unit for forming an electrostatic latent image on the surface of the photoconductor drum; a developing device for supplying a toner to the electrostatic latent image on the surface of the photoconductor drum, to form a toner image; a toner cartridge for supplying the toner to the developing device; a transfer unit for transferring, to a recording medium, the toner image on the surface of the photoconductor drum; and a fuser unit for fusing, onto the recording medium, the toner image having been transferred, and the toner cartridge has the features described above.

According to the present invention, occurrence of the locking of the toner discharge member can be prevented, and a stable image concentration can be obtained.

Hereinafter, the present invention will be described in detail based on an embodiment shown in the drawings.

(Image Forming Apparatus)

FIG. 1 is a diagram illustrating a structure of an image forming apparatus according to the present invention.

As shown in FIG. 1, the image forming apparatus 100 includes: photoconductor drums 101*a*, 101*b*, 101*c*, and 101*d* having surfaces on which electrostatic latent images are formed; developing devices 102*a*, 102*b*, 102*c*, and 102*d* for supplying a toner to the electrostatic latent images on the surfaces of the photoconductor drums 101*a*, 101*b*, 101*c*, and 101*d*, respectively, to form toner images; toner cartridges 200 for supplying the toner through toner supply pipes 105*a*, 105*b*, 150*c*, and 150*d* to the developing devices 102*a*, 102*b*, 102*c*, and 102*d*, respectively; a secondary transfer roller (transfer unit) 14 for transferring, onto a paper, a toner image of each of the surfaces of the photoconductor drums 101*a*, 101*b*, 101*c*, and 101*d* through an intermediate transfer belt 11; and a fuser unit 15 for fusing the toner image onto the paper. Each of the toner cartridges 200 includes a toner discharge mechanism of which details will be described later. The image forming apparatus 100 forms an image by using a toner in an electrophotographic method.

The image forming apparatus 100 forms, as a visible image, a multicolored image or a monochromatic image on a predetermined sheet (recording paper), based on image data contained in an input command, such as image data transmitted from the outside via a communication network and/or the like.

The image forming apparatus 100 includes: an exposure unit E; the photoconductor drums 101*a*, 101*b*, 101*c*, and 101*d* which act as image holders on which latent images are formed by the exposure unit E; the developing devices 102*a*, 102*b*, 102*c*, and 102*d*; charging rollers 103*a*, 103*b*, 103*c*, and 103*d*; cleaning units 104*a*, 104*b*, 104*c*, and 104*d*; the intermediate transfer belt 11; primary transfer rollers 13*a*, 13*b*, 13*c*, and 13*d*; the secondary transfer roller 14; the fuser unit 15; paper conveying paths P1, P2, and P3; a paper feed cassette 16; a manual bypass tray 17; a paper output tray 18; a toner cartridge unit 20; and the like, as shown in FIG. 1.

Image data of color images processed by the image forming apparatus 100 are image data corresponding to four hues of black (K), cyan (C), magenta (M), and yellow (Y) colors, and the image forming apparatus 100 forms visible images by using the image data corresponding to the four hues by means of image forming units 55*a*, 55*b*, 55*e*, and 55*d*.

The image forming units 55*a*, 55*b*, 55*c*, and 55*d* process color images by using the respective colors. Therefore, the number of the developing devices 102*a*, 102*b*, 102*e*, and 102*d* provided, the number of the photoconductor drums 101*a*, 101*b*, 101*c*, and 101*d* provided, the number of the charging rollers 103*a*, 103*b*, 103*c*, and 103*d* provided, and the number of the cleaning units 104*a*, 104*b*, 104*c*, and 104*d* provided are each four so as to form four kinds of latent images corresponding to the respective colors.

The image forming units 55*a*, 55*b*, 55*e*, and 55*d* have the same structure therebetween. For example, the black image forming unit 55*a* includes: the photoconductor drum 101*a*; the developing device 102*a*; the charging roller 103*a*; the transfer roller 13*a*; the cleaning unit 104*a*, and the like.

The image forming units 55*a*, 55*b*, 55*c*, and 55*d* are aligned along the moving direction (secondary scanning direction) in which the intermediate transfer belt 11 moves. Reference numerals a, b, c, and d as described above represent black color, cyan color, magenta color, and yellow color, respectively. The components described above are classified so as to be represented by a corresponding one of the reference numerals, and form a corresponding one of the four image forming units 55*a*, 55*b*, 55*c*, and 55*d*.

The exposure unit E, which is an exposure device, includes a semiconductor laser (not shown), a polygon mirror 4, first reflective mirrors 7, second reflective mirrors 8, and the like. The exposure unit E is operable to apply, to the photoconductor drums 101*a*, 101*b*, 101*c*, and 101*d*, laser beams which have been modulated based on image data corresponding to the hues of black, cyan, magenta, and yellow colors, respectively.

Electrostatic latent images based on the image data of the hues of the black, cyan, magenta, and yellow colors are formed on the photoconductor drums 101*a*, 101*b*, 101*c*, and 101*d*, respectively.

The exposure unit E which uses a laser scanning unit (LSU) including a laser application section and a reflective mirror is used is some cases. However, for example, the exposure unit which uses an EL (electroluminescence) device having light emitting devices aligned in an array, or which uses an LED write head, may be used.

The photoconductor drums 101*a*, 101*b*, 101*c*, and 101*d* are provided above the exposure unit E. Each of the photoconductor drums 101*a*, 101*b*, 101*c*, and 101*d* is formed as an image holder having almost a cylindrical shape, and is controlled so as to rotate in a predetermined direction by driving means and control means which are not shown. The photoconductor drums 101*a*, 101*b*, 101*c*, and 101*d* each have a photoconductive layer formed on a base component.

For example, each of the photoconductor drums 101*a*, 101*b*, 101*c*, and 101*d* is structured such that a metal drum formed of aluminium and/or the like is used as a base component, and a photoconductive layer formed of an amorphous silicon (a-Si), selenium (Se), an organic photo semiconductor (OPC), and/or the like, is formed as a thin film on the outer diameter surface of the base component. The structure of the photoconductor drums 101*a*, 101*b*, 101*c*, and 101*d* is not limited to this structure.

Each of the charging rollers 103*a*, 103*b*, 103*c*, and 103*d* is a contact type charger which is operable to uniformly charge the surface of a corresponding one of the photoconductor drums 101*a*, 101*b*, 101*c*, and 101*d* at a predetermined potential. In the present embodiment, as shown in FIG. 1, contact roller type charging rollers 103*a*, 103*b*, 103*c*, and 103*d* are used as chargers. However, a charger-type charging device or a brush-type charger may be used.

The developing devices 102*a*, 102*b*, 102*c*, and 102*d* supply the toner onto the surfaces of the photoconductor drums 101*a*, 101*b*, 101*c*, and 101*d*, respectively, on which the electrostatic latent images are formed, to develop the electrostatic latent images into toner images. The developing devices 102*a*, 102*b*, 102*c*, and 102*d* store toners of the hues of the black, cyan, magenta, and yellow colors, respectively, and develop the electrostatic latent images of the hues formed on the photoconductor drums 101*a*, 101*b*, 101*c*, and 101*d*, into toner images of the hues of the black, cyan, magenta, and yellow colors, respectively, to form visible images.

The cleaning units 104*a*, 104*b*, 104*c*, and 104*d* remove and collect toners which are left on the surfaces of the photoconductor drums 101*a*, 101*b*, 101*c*, and 101*d*, respectively, by using a lubricant and/or the like, after the development and image transfer.

The intermediate transfer belt 11 is provided above the photoconductor drums 101*a*, 101*b*, 101*c*, and 101*d*, and is extended on a driving roller 11*a* and a follower roller 11*b* to form a loop-shaped moving path. The outer diameter surface of the intermediate transfer belt 11 is opposed to the photoconductor drum 101*d*, the photoconductor drum 101*c*, the photoconductor drum 101*b*, and the photoconductor drum 101*a* in order, respectively.

The primary transfer rollers 13*a*, 13*b*, 13*c*, and 13*d* are provided at positions opposing the photoconductor drums 101*a*, 101*b*, 101*c*, and 101*d*, respectively, so as to sandwich the intermediate transfer belt 11. Positions at which the intermediate transfer belt 11 is opposed to the photoconductor drums 101*a*, 101*b*, 101*c*, and 101*d* correspond to primary transfer positions, respectively. The intermediate transfer belt 11 is formed as an endless belt by using a film having a thickness ranging from about 100 μm to about 150 μm.

Primary transfer bias for transferring, onto the intermediate transfer belt 11, the toner images held on the surfaces of the photoconductor drums 101*a*, 101*b*, 101*c*, and 101*d*, are applied to the primary transfer rollers 13*a*, 13*b*, 13*c*, and 13*d*, respectively, by constant voltage control, and the primary transfer bias represents a polarity opposite to a polarity of a charged toner. Thus, the toner images of the hues formed on the photoconductor drums 101*a*, 101*b*, 101*c*, and 101*d*, respectively, are sequentially transferred and superimposed on the outer diameter surface of the intermediate transfer belt 11, so that a full color toner image is formed on the outer diameter surface of the intermediate transfer belt 11.

However, when image data of only one or some of the hues of the yellow, magenta, cyan, and black colors is inputted, the electrostatic latent image and the toner image are formed on only the photoconductor drum(s), corresponding to the hue(s) of the inputted image data, among the four photoconductor drums 101*a*, 101*b*, 101*c*, and 101*d*.

For example, when a monochromatic image is formed, the electrostatic latent image and the toner image are formed on only the photoconductor drum 101*a* corresponding to the hue of the black color, and only the black toner image is transferred onto the outer diameter surface of the intermediate transfer belt 11.

Each of the primary transfer rollers 13*a*, 13*b*, 13*c*, and 13*d* has a shaft made of a metal (for example, a stainless steel) having a diameter ranging from 8 mm to 10 mm, and the surface of the shaft is covered with a conductive elastic material (for example, an EPDM). The conductive elastic material enables a high voltage to be uniformly applied to the intermediate transfer belt 11. Although in the present embodiment the primary transfer rollers 13*a*, 13*b*, 13*c*, and 13*d* are used as transfer electrodes, brushes may be also used as the transfer electrodes.

The toner images having been transferred onto the outer diameter surface of the intermediate transfer belt 11 at the respective primary transfer positions are conveyed to a secondary transfer position opposing the secondary transfer roller 14, by the rotation of the intermediate transfer belt 11. When an image is formed, the secondary transfer roller 14 presses and contacts, at a predetermined nipping pressure, the outer diameter surface of the intermediate transfer belt 11 which has the inner diameter surface contacting the outer surface of the driving roller 11*a*.

In order to constantly obtain the nipping pressure, one of the secondary transfer roller 14 or the intermediate transfer belt driving roller 11*a* is formed of a hard material such as a metal, and the other thereof is formed of a flexible material as an elastic roller or the like (an elastic rubber roller, a foamable resin roller, or the like).

When a paper fed from the paper feed cassette 16 or the manual bypass tray 17 passes between the secondary transfer roller 14 and the intermediate transfer belt 11, a high voltage having a polarity (+) opposite to a polarity (−) of a charged toner is applied to the secondary transfer roller 14. In the manners described above, the electrostatic latent images on the photoconductor drums 101*a*, 101*b*, 101*c*, and 101*d* are developed into visible images by using toners corresponding to the hues, to form toner images, respectively. The toner images are transferred and superimposed on the intermediate transfer belt 11.

The superimposed toner image is moved to a contact position at which a paper having been conveyed contacts the intermediate transfer belt 11, by the rotation of the intermediate transfer belt 11, and the toner image is transferred onto the paper from the outer diameter surface of the intermediate transfer belt 11 by means of the secondary transfer roller 14 located at the contact position.

The Toner which has not been transferred during the transfer of the toner image from the intermediate transfer belt 11 onto the paper, and has been left on the intermediate transfer belt 11, is removed and collected by the intermediate transfer belt cleaning unit 12 because the toner may cause mixture of the toner colors in subsequent process steps.

For example, a cleaning blade is provided, as a cleaning member of the intermediate transfer belt cleaning unit 12, so as to contact the intermediate transfer belt 11. A portion of the intermediate transfer belt 11 which contacts the cleaning blade is supported by the intermediate transfer belt follower roller 11*b* from the reverse side of the intermediate transfer belt 11.

A paper on which the toner image has been transferred as a visible image is guided by the fuser unit 15 including a heating roller 15*a* and a pressure-applying roller 15*b*, so as to pass between the heating roller 15*a* and the pressure-applying roller 15*b*, thereby subjecting the paper to heating and pressure-applying processes. Thus, the toner image is fixedly fused onto the surface of the paper as a visible image. The paper onto which the toner image has been fused is discharged onto the paper output tray 18 by means of the paper discharge roller 18*a*.

The image forming apparatus 100 includes the paper conveying path P1, and the paper conveying path P1 almost vertically extends so as to convey a paper stored in the paper feed cassette 16 to the paper output tray 18 by passing the paper between the secondary transfer roller 14 and the intermediate transfer belt 11, and through the fuser unit 15.

In the paper conveying path P1, a pickup roller 16*a* for feeding a paper stored in the paper feed cassette 16, one by one, into the paper conveying path P1, a conveying roller r10 for conveying the fed paper in the upstream direction, a resist roller 19 for guiding the conveyed paper so as to pass the paper between the secondary transfer roller 14 and the intermediate transfer belt 11 at a predetermined time, and the paper discharge roller 18*a* for discharging the paper onto the paper output tray 18, are provided.

Moreover, in the image forming apparatus 100, the paper conveying path P2 is formed so as to extend from the manual bypass tray 17 to the resist roller 19. In the paper conveying path P2, the pickup roller 17*a* and the conveying rollers r10 are provided. Furthermore, the paper conveying path P3 is formed so as to extend from the paper discharge roller 18*a* to the upstream portion of the paper conveying path P1 above the resist roller 19.

The paper discharge roller 18*a* is rotatable in both the forward direction and the opposite direction. In a one-surface image formation in which an image is formed on one surface of a paper, and in a second surface image formation of a both surfaces image formation in which images are formed on both surfaces of a paper, the paper discharge roller 18*a* is driven to rotate in the forward direction to discharge the paper onto the paper output tray 18.

On the other hand, in a first surface image formation of the both surfaces image formation, the paper discharge roller 18*a* is driven to rotate in the forward direction until the back end edge of a paper has passed the fuser unit 15, and thereafter the paper discharge roller 18*a* is driven to rotate in the opposite direction in a state where the back end portion of the paper is being held, to guide the paper into the paper conveying path P3. Thus, the paper on which an image has been formed only on one surface in the both surfaces image formation is guided into the paper conveying path P1 with the front and the back surfaces being reversed and the head and the bottom being opposite.

The resist roller 19 guides the paper having been conveyed from the paper feed cassette 16 or the manual bypass tray 17, or the paper having been conveyed through the paper conveying path P3, so as to pass the paper between the secondary transfer roller 14 and the intermediate transfer belt 11 in synchronization with the rotation of the intermediate transfer belt 11.

Therefore, the resist roller 19 does not rotate when operations of the photoconductor drums 101*a*, 101*b*, 101*c*, and 101*d*, and the intermediate transfer belt 11 start. A paper which has been fed or conveyed prior to the rotation of the intermediate transfer belt 11 stops in the paper conveying path P1 in a state where the head of the paper is in contact with the resist roller 19. Thereafter, the resist roller 19 starts to rotate, at a time when the head portion of the paper is caused to oppose the front edge portion of the toner image formed on the intermediate transfer belt 11, at a position at which the secondary transfer roller 14 and the intermediate transfer belt 11 press and contact each other.

When a full color image formation is performed in which all of the image forming units 55*a*, 55*b*, 55*c*, and 55*d* form images, respectively, the primary transfer rollers 13*a*, 13*b*, 13*c*, and 13*d* are operable to cause each of the photoconductor drums 101*a*, 101*b*, 101*c*, and 101*d* and the intermediate transfer belt 11 to press and contact each other. On the other hand, when a monochromatic image formation is performed in which only the image forming unit 55*a* forms an image, only the primary transfer roller 13*a* is operable to cause the photoconductor drum 101*a* and the intermediate transfer belt 11 to press and contact each other.

(Toner Cartridge and Toner Discharge Mechanism)

Next, structures of the toner cartridge and the toner discharge mechanism according to the present embodiment will be described in detail with reference to the drawings.

Figure 2:
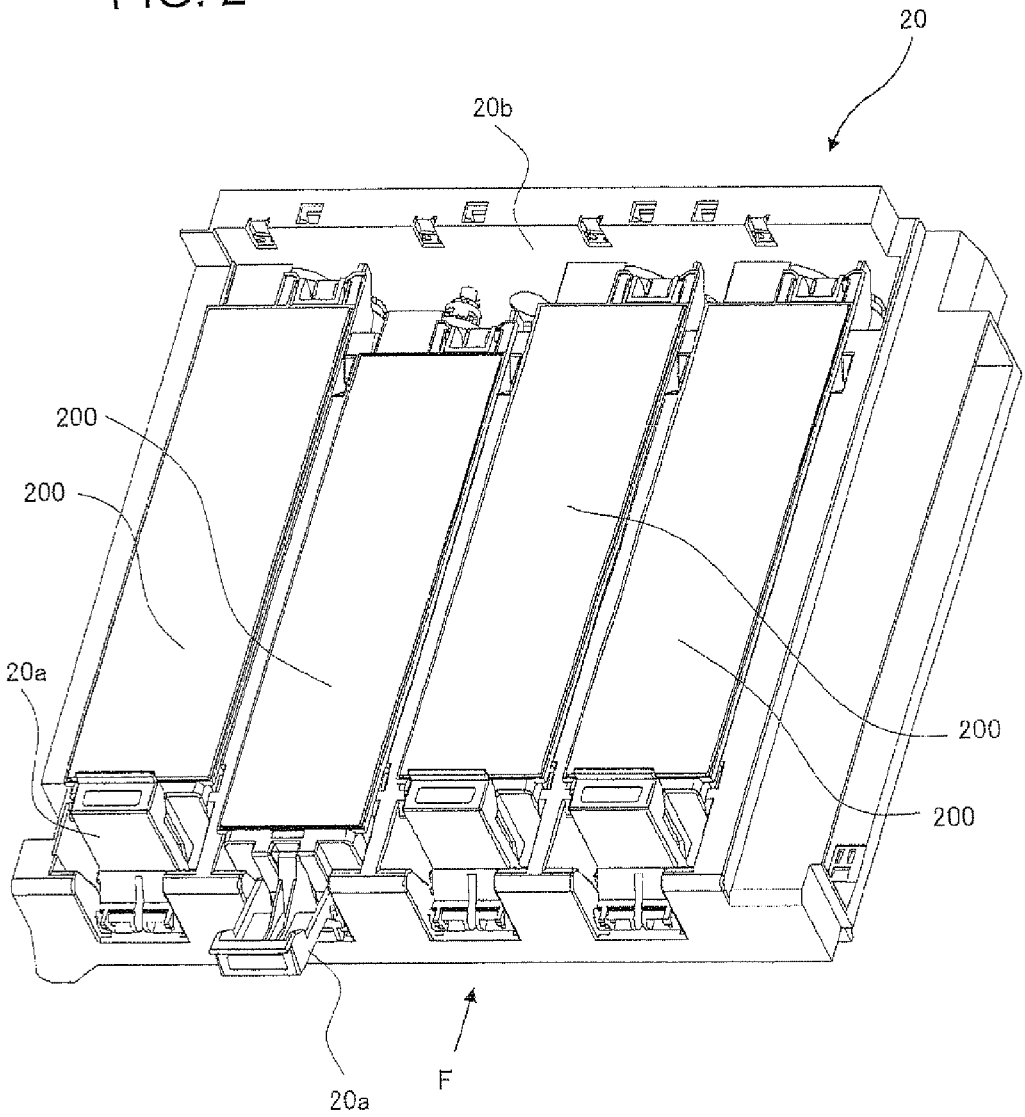
FIG. 2 is a perspective view of a toner cartridge according to the present invention.
Figure 3:
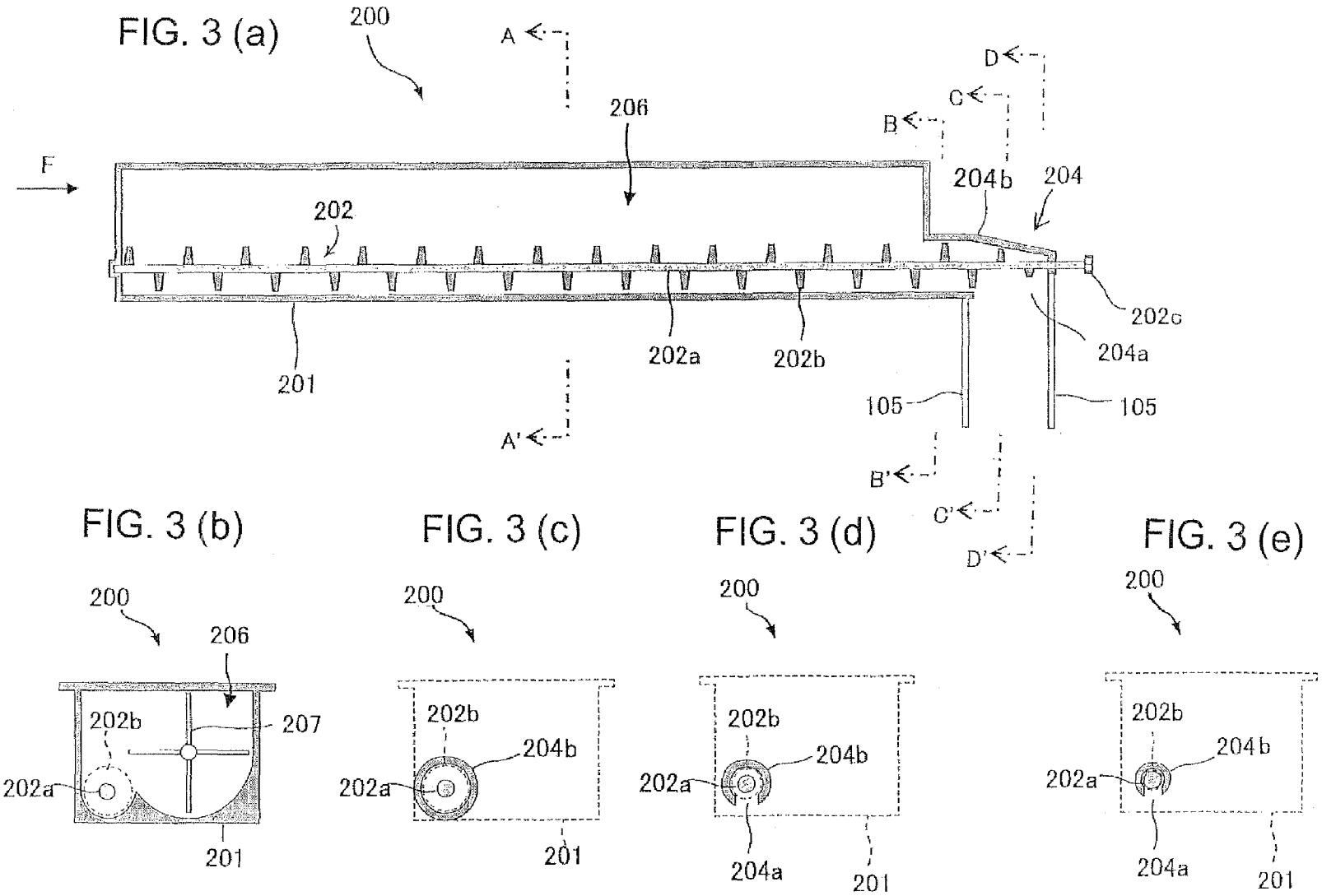
FIGS. 3(*a*)-3(*e*) are diagrams illustrating structures of the toner cartridge and a toner discharge mechanism according to the present invention.
Figure 4:
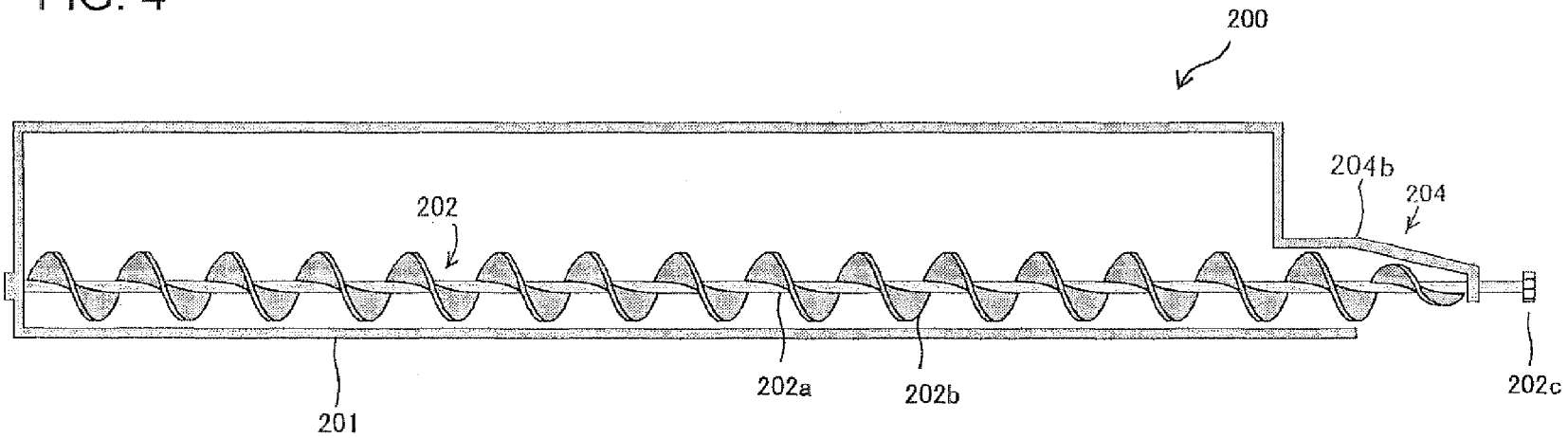
FIG. 4 is a cross-sectional view of the toner cartridge and the toner discharge mechanism according to the present invention.
Figure 5:
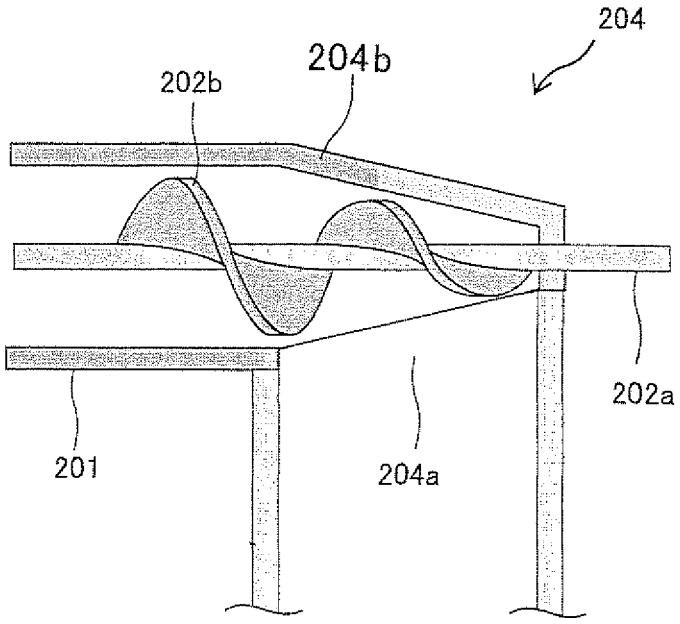
FIG. 5 is a cross-sectional view of the toner discharge mechanism according to the present invention.

FIG. 2 is a perspective view illustrating a structure of the toner cartridge unit 20 which includes the toner cartridges 200 and which is mounted to the image forming apparatus 100. FIG. 3(*a*) is a cross-sectional view of the toner cartridge 200. FIG. 3(*b*) is a cross-sectional view of the toner cartridge 200 taken along A-A' of FIG. 3(*a*). FIG. 3(*c*) a cross-sectional view of the toner cartridge 200 taken along B-B' of FIG. 3(*a*). FIG. 3(*d*) is a cross-sectional view of the toner cartridge 200 taken along C-C of FIG. 3(*a*). FIG. 3(*e*) is a cross-sectional view of the toner cartridge 200 taken along D-D' of FIG. 3(*a*). FIG. 4 is a side view of an auger screw 202. FIG. 5 is a diagram illustrating a structure of the toner discharge mechanism.

As shown in FIG. 2, in the present embodiment, the number of the toner cartridges 200 is four, and the four toner cartridges 200 are aligned on the toner cartridge unit 20. Each toner cartridge 200 is held such that the toner cartridge 200 is moved in the direction indicated by an arrow F, and is pressed against a stopper plate 20*b* by moving a locking lever 20*a* upward, as shown in FIG. 2.

Each toner cartridge 200 includes a toner container 201 which contains a toner; an auger screw 202, and an agitating paddle 207, as shown in FIG. 3(*a*) and FIG. 3(*b*). The toner container 201 includes a toner storage section 206 having an agitating paddle 207 mounted therein.

Further, the toner container 201 is a container which has a substantially prismatic shape, and stores the toner. The toner container 201 includes a toner discharge mechanism 204 (FIG. 3(*a*)) in one end portion having a predetermined length, and the toner container 201 rotatably supports the auger screw 202 such that the auger screw 202 extends through the toner storage section 206 and the toner discharge mechanism 204.

The toner discharge mechanism 204 includes a cover member 204*b* having a cylindrical inner wall portion and a conical inner wall portion. In the conical inner wall portion of the cover member 204*b*, the auger screw 202 has a tapered portion which diminishes toward the tip thereof in the toner conveying direction. The conical inner wall portion has an inner diameter gradually reduced toward the tip of the auger screw 202 so as to correspond to a tapered shape of the tapered portion.

In the present embodiment, a minimal value of the inner diameter of the conical inner wall portion is 0.3 times a maximal value of the inner diameter of the conical inner wall portion. A toner discharge outlet 204*a* is formed on a curved surface forming the conical inner wall of the cover member 204*b*.

The toner discharge mechanism 204 will be described in more detail.

The auger screw 202 includes a rotating shaft 202*a*, a helical blade 202*b*, and a drive gear 202*c*, as shown in FIGS. 3 and 4. The auger screw 202 rotates coaxially with a central axis of the cylindrical inner wall portion and the conical inner wall portion of the cover member 204*b*, to convey the toner in the toner storage section 206, toward the toner discharge outlet 204*a*, that is, to convey the toner in the rightward direction (in the direction indicated by the arrow F) in FIG. 3(*a*).

The helical blade 202*b* has its outer diameter gradually reduced toward the right edge of the auger screw 202, in a position facing the toner discharge outlet 204*a*, that is, in a position above the toner discharge outlet 204*a* as shown in FIG. 3(*a*) (see FIG. 3(*c*), FIG. 3(*d*), and FIG. 3(*e*)).

In the present embodiment, the minimal value of the inner diameter of the conical inner wall portion is greater than or equal to 1.1 times the diameter of the rotating shaft 202*a* of the auger screw 202, and is not greater than 1.5 times the diameter of the rotating shaft 202*a* of the auger screw 202. Further, the minimal value of the inner diameter of the conical inner wall portion is greater than or equal to 0.2 times the maximal value of the inner diameter of the conical inner wall portion, and is not greater than 0.5 times the maximal value of the inner diameter of the conical inner wall portion.

A minimal value of the outer diameter of the helical blade 202*b* of the auger screw 202 is set to be 0.25 times the maximal value of the inner diameter of the conical inner wall portion. A maximal value of the outer diameter of the helical blade 202*b* of the auger screw 202 is set to be 0.9 times the maximal value of the inner diameter of the conical inner wall portion.

The helical blade 202*b* has a helix structure adapted to convey the toner toward the toner discharge outlet 204*a* by the rotation of the auger screw 202, and the outer diameter of the helical blade 202*b* is reduced toward the downstream side. Therefore, an amount of the toner conveyed is reduced toward the downstream side.

The agitating paddle 207 (FIG. 3(*b*)) is an agitator having four agitating blades formed around a rotating shaft. The agitating paddle 207 rotates to loosen the toner in the toner storage section 206.

The toner discharge outlet 204*a* is a quadrate opening formed on the bottom of the toner discharge mechanism 204 in the toner container 201. The toner conveyed by the auger screw 202 is discharged through the toner discharge outlet 204*a* toward a corresponding one of the developing devices 102*a*, 102*b*, 102*c*, and 102*d* (FIG. 1).

What is claimed is:

1. A toner discharge mechanism which is attached to a toner cartridge comprising:

an auger screw for conveying and discharging a toner stored in the toner cartridge, the auger screw having an end portion downstream thereof, the end portion forming a taper portion having a predetermined length and an outer diameter diminishing toward a tip thereof;

a cover member for covering the taper portion, the cover member having a conical inner wall configured to correspond to a taper shape of the taper portion; and a toner discharge outlet formed on the conical inner wall of the cover member from a maximal inner diameter portion thereof to a minimal inner diameter portion thereof.

2. The toner discharge mechanism of claim 1, wherein the auger screw has a rotating shaft and the conical inner wall has a minimal inner diameter which is from 1.1 to 1.5 times the diameter of the rotating shaft.

3. The toner discharge mechanism of claim 1, wherein the conical inner wall has a minimal inner diameter which is from 0.2 to 0.5 times the maximal inner diameter thereof.

4. A toner cartridge comprising:

an auger screw for conveying and discharging a toner stored in the toner cartridge, the auger screw having an end portion downstream thereof, the end portion forming a taper portion having a predetermined length and an outer diameter diminishing toward a tip thereof;

a cover member for covering the taper portion, the cover member having a conical inner wall configured to correspond to a taper shape of the taper portion; and a toner discharge outlet formed on the conical inner wall of the cover member from a maximal inner diameter portion thereof to a minimal inner diameter portion thereof.

5. The toner cartridge of claim 4, wherein the auger screw has a rotating shaft and the conical inner wall has a minimal inner diameter which is from 1.1 to 1.5 times the diameter of the rotating shaft.

6. The toner cartridge of claim 4, wherein the conical inner wall has a minimal inner diameter which is from 0.2 to 0.5 times the maximal inner diameter thereof.

7. An image forming apparatus comprising:

a photoconductor drum;

a charging device for charging a surface of the photoconductor drum;

an exposure unit for forming an electrostatic latent image on the surface of the photoconductor drum;

a developing device for supplying a toner to the electrostatic latent image on the surface of the photoconductor drum to form a toner image;

a toner cartridge for supplying the toner to the developing device;

a transfer unit for transferring the toner image to recording medium; and a fuser unit for fusing the toner image onto the recording medium, wherein the toner cartridge is a toner cartridge as in claim 4.

* * * * *